US011116252B2

(12) United States Patent
Rath et al.

(10) Patent No.: US 11,116,252 B2
(45) Date of Patent: Sep. 14, 2021

(54) VAPORIZER DEVICE FOR AN INHALER, IN PARTICULAR FOR AN ELECTRONIC CIGARETTE PRODUCT, AND FABRICATION METHOD

(71) Applicant: HAUNI MASCHINENBAU GMBH, Hamburg (DE)

(72) Inventors: Sonali Rath, Heilsbronn (DE); Muhannad Ghanam, Freiburg (DE); Jan Jaklin, Freiburg (DE); Uwe Pelz, Schallstadt (DE); Peter Woias, Freiburg (DE); Frank Goldschmidtböing, Ortenberg, DE (US)

(73) Assignee: HAUNI MASCHINENBAU GMBH, Hamburg (DE)

( * ) Notice: Subject to any disclaimer, the term of this patent is extended or adjusted under 35 U.S.C. 154(b) by 369 days.

(21) Appl. No.: 16/225,544

(22) Filed: Dec. 19, 2018

(65) Prior Publication Data

US 2019/0183180 A1 Jun. 20, 2019

(30) Foreign Application Priority Data

Dec. 19, 2017 (DE) ..... 102017130501.7

(51) Int. Cl.
*A24F 40/46* (2020.01)
*A24F 40/70* (2020.01)
*A24F 40/10* (2020.01)

(52) U.S. Cl.
CPC ..... *A24F 40/46* (2020.01); *A24F 40/70* (2020.01); *A24F 40/10* (2020.01)

(58) Field of Classification Search
CPC ..... A24F 47/008; A24F 40/46; A61M 11/042; A61M 11/041; A61M 11/044
See application file for complete search history.

(56) References Cited

U.S. PATENT DOCUMENTS 5,573,692 A * 11/1996 Das ..... A24F 40/70 219/543
10,524,518 B1 * 1/2020 Tygett ..... A24F 40/50
(Continued)

FOREIGN PATENT DOCUMENTS

DE 10 2014 114 133 A1 3/2016
DE 10 2016 120 803 A1 5/2018
(Continued)

OTHER PUBLICATIONS

Examination Report issued by the German Patent and Trademark Office for German patent application DE 10 2017 130 501.7, filed Dec. 19, 2017 (priority application) dated Sep. 3, 2018.
(Continued)

*Primary Examiner* — Abdullah A Riyami
*Assistant Examiner* — Marcus E Harcum
(74) *Attorney, Agent, or Firm* — Saliwanchik, Lloyd & Eisenschenk

(57) ABSTRACT

A vaporizer device for an inhaler, in particular for an electronic cigarette product, comprises an electrical vaporizer having one or more heating elements for vaporizing liquid supplied by the vaporizer. The vaporizer device is characterized in that a carrier is formed of a layer system with a polymer film and at least one metal film in contact with the polymer film in a planar manner, the polymer film comprises at least one fluid permeable opening, the metal film comprises at least one fluid permeable second opening communicating with the first opening, and the metal film forms the heating elements, wherein the heating elements are arranged delimiting the second opening.

18 Claims, 2 Drawing Sheets

(56) References Cited

U.S. PATENT DOCUMENTS

| | | | | |
|---|---|---|---|---|
| 2012/0113497 | A1* | 5/2012 | Woias | F16K 99/0015 359/288 |
| 2014/0286630 | A1* | 9/2014 | Buchberger | A61M 11/041 392/395 |
| 2016/0007653 | A1* | 1/2016 | Tu | F22B 1/284 392/403 |
| 2016/0128390 | A1* | 5/2016 | Liu | H05B 3/03 392/386 |
| 2016/0345629 | A1* | 12/2016 | Mironov | A61M 11/042 |
| 2017/0020193 | A1* | 1/2017 | Davis | A61M 15/06 |
| 2017/0258142 | A1* | 9/2017 | Hatton | H05B 1/0244 |
| 2017/0303588 | A1* | 10/2017 | Batista | A24F 40/46 |
| 2017/0360094 | A1* | 12/2017 | Kuczaj | A24F 47/008 |
| 2018/0007741 | A1* | 1/2018 | Metz | H05B 3/283 |
| 2018/0235278 | A1* | 8/2018 | Mahler | A24F 40/46 |
| 2019/0001077 | A1* | 1/2019 | Xu | A24F 40/44 |
| 2019/0246696 | A1* | 8/2019 | Schmidt | A61M 11/042 |
| 2020/0046027 | A1* | 2/2020 | Ghanouni | A24D 1/14 |

FOREIGN PATENT DOCUMENTS

| | | | |
|---|---|---|---|
| DE | 10 2017 111 119 | A1 | 11/2018 |
| EP | 2316286 | A1 | 10/2016 |
| EP | 3075273 | A1 | 10/2016 |
| WO | WO 2018/083007 | A1 | 5/2018 |

OTHER PUBLICATIONS

Extended European Search Report issued by the European Patent Office on May 7, 2019 for parallel European patent application 18210092.5.

* cited by examiner

VAPORIZER DEVICE FOR AN INHALER, IN PARTICULAR FOR AN ELECTRONIC CIGARETTE PRODUCT, AND FABRICATION METHOD

CROSS REFERENCE TO A RELATED APPLICATION

This application claims priority under 35 U.S.C. § 119(e) of German Patent Application No. DE 10 2017 130 501.7, filed Dec. 19, 2017, which is incorporated herein by reference in its entirety.

FIELD OF THE INVENTION

The present invention relates to a vaporizer device for an inhaler, in particular for an electronic cigarette product, comprising an electrical vaporizer having one or more heating elements for vaporizing liquid supplied by the vaporizer. The invention relates further to a corresponding inhaler, a vaporizer unit and a cartridge for an inhaler as well as a method for fabricating a vaporizer device.

BACKGROUND OF THE INVENTION

At present between one and up to five vaporizer heads based on the wick-coil principle are used in current electronic cigarettes. The planar vaporization of liquid directly at the liquid surface is also another approach in addition to common wick-coil E-cigarettes; see, for example, Patent Application DE 10 2016 120 803.5. In the case of heating via a wire grid, also called a mesh, a non-homogeneous temperature field can develop over the vaporizer surface, because the heat output is namely substantially constant over the mesh surface, but the heat dissipation is very non-homogeneous due to the locally different subsequent conveyance of liquid and even local desiccation as the case may be.

Regulating the vaporizer temperature using the temperature dependent heater resistor is possible. However, since only one temperature averaged over the entire heater surface is recorded in this way, only very large local temperature increases can be detected based on desiccation. In addition, a subsequent reduction in the heat output would also affect regions that are at the correct temperature and reduce the temperature there, and thereby reduce the quantity of vapor generated.

These problems are reduced by distributing the vaporizer surface into individual, separately regulated regions, as described in Patent Application DE 10 2017 111 119.0. A possible realization of a planar vaporizer with separable regions is described in Patent Application DE 10 2016 120 803.5. However, the silicon MEMS technology described there is relatively expensive. In addition, the individual channels of the vaporizer chip are electrically connected to the corresponding regulating electronics, which leads an increased installation expense.

BRIEF DESCRIPTION OF THE INVENTION

The objective of the invention is to make available a vaporizer device and a fabrication method, which allow the most cost effective fabrication with simultaneously higher aerosol or vapor quality and intensity.

This objective is attained by the invention with the features of the independent claims.

The invention proposes that a carrier is formed of a layer system with a polymer film and at least one metal film in contact with the polymer film in a planar manner, that the polymer film comprises at least one fluid permeable first opening, that the metal film comprises at least one fluid permeable second opening communicating with the first opening, and that the metal film forms the heating elements, wherein the heating elements are arranged delimiting the second opening.

The invention has shown that a planar vaporization can be achieved by a film-based heater with a layer structure, which simultaneously enables high-quality vaporization or aerosol formation and cost effective production of the heater. The carrier formed from the layer system by at least the polymer film and the metal film is film-based and the heating elements are attached directly on the carrier, which can also be designated as a circuit carrier. The planar contact between the polymer film and the metal film produces a bond, which for one comprises electrically conductive regions as well as electrically insulating regions in order to enable a suitable layout of the carrier and therefore a suitable connection of electrical and/or electronic components.

The invention provides for the first opening of the polymer film and the second polymer film to communicate in order to enable the transport of fluid throughout the carrier. Therefore, the first opening is preferably arranged in regions which can be assigned to the second opening. The heating elements are formed by the regions of the metal film delimiting the second opening in order to make possible a vaporization or aerosol formation of the liquid flowing through the carrier and supplied to the vaporizer.

The metal film preferably has a passivating coating at least on the sections not in contact with the polymer film and/or the heating elements in order to prevent parts of the metal film from disconnecting. The passivating coating or passivation preferably consists of a non-metallic and temperature stable material, for example silicon dioxide, quartz glass, or silicon nitrite, which can be applied for example by low temperature deposition. In other embodiments, temperature stable polymers, such as parylene, are possible or electroplating the heating elements with a noble metal, for example gold.

The carrier advantageously comprises a metal layer, which is in contact with the polymer film on the side that is opposite from the metal film in order to be able to fabricate the heating elements and the electrical conducting tracks from different materials for example. The metal layer is preferably provided with a passivating coating in order to prevent parts of the metal layer from disconnecting.

The carrier preferably comprises at least one contact for making electrical contact with an electronic component in order to be able to connect electronic components such as an integrated control/regulation device for example. The contact can be designed as a solder contact or as a plug contact, for example. The contacts preferably extend through several layers or films of the carrier. For example, the contacts can be mechanically mounted substantially through the polymer film, but make contact with the metal film and preferably the metal layer in order to guarantee an electrical connection between the conductive layers of the carrier and the electrical/electronic components attached in/on the contacts.

The carrier preferably comprises regions having different thicknesses in order to take into account the structural mechanical and electrical circumstances and make a flexible and versatile design of the vaporizer device possible.

The carrier preferably comprises regions having different bending strengths in order to be able to incorporate the carrier into a plurality of inhalers. The carrier is designed as a rigid flex substrate, which has flexible and rigid regions connected with one another electrically and/or mechanically. In other embodiments, the film-based carrier is completely rigid or flexible.

In a preferred embodiment, the carrier comprises a liquid interface for the standardized connection with a liquid tank, wherein the liquid interface communicates with the first opening and/or the second opening in order to facilitate a direct connection of the vaporizer device to the liquid tank or possibly a plurality of replaceable liquid tanks. The carrier preferably comprises at least one passage opening for transporting liquid from the liquid interface to the vaporizer in order to facilitate the transport of fluid from the liquid tank to the vaporizer and/or of vaporized liquid from the vaporizer into an air flow. The passage opening is preferably formed by the first openings and the second openings.

In a preferred embodiment, an electrical plug connector part is formed on an edge of the carrier, which is configured for reversible interaction with a corresponding plug connector part of a base part of the inhaler and for supplying the vaporizer device with electrical energy and/or for receiving control signals for the vaporizer device in order to be able to integrate the vaporizer device cost effectively into an inhaler.

In a preferred embodiment, an electronic control device for controlling and/or regulating the vaporizer device is mounted on the carrier in order to be able to accommodate electronic components such as an integrated control/regulation device.

The invention relates furthermore to a vaporizer unit for an inhaler comprising a vaporizer device and a capillary element for conveying fluid to the vaporizer.

In a preferred embodiment, the capillary element extends at least partially through the first opening and/or the second opening in order to facilitate a reliable conveyance of liquid that is independent of the orientation from the liquid tank to the vaporizer for example.

The invention relates furthermore to a cartridge for an inhaler comprising at least the vaporizer device and the liquid tank in order to be able to integrate the vaporizer device according to the invention into a standardized component. The carrier, or the first opening and second opening thereof, preferably communicate with the liquid tank in order to guarantee the transport of fluid to the vaporizer. Furthermore, it is further preferred that the vaporizer device is attached on the liquid tank, for example on the carrier, in order to establish a direct contact. The contact is preferably facilitated by a liquid interface and/or a capillary element for the conveyance of fluid.

The invention relates further to a method for fabricating a vaporizer device according to the invention, which is made up of the following steps:

- the polymer film and the metal film are connected to each other in a planar manner,
- the metal film is structured in order to form the second opening, conducting tracks and/or heating elements,
- the polymer film is structured in order to form the first opening. The cited fabrication steps can be executed in any arbitrary order. In particular, already structured films can be placed on one another in a planar manner.

The metal layer is preferably connected to the polymer film on the side of the polymer film that is opposite from the metal film. In a preferred embodiment, the metal film and/or the metal layer is/are provided with a passivating coating.

The invention will be explained in the following based on preferred embodiments making reference to the enclosed figures, which show:

DETAILED DESCRIPTION

Figure 1:
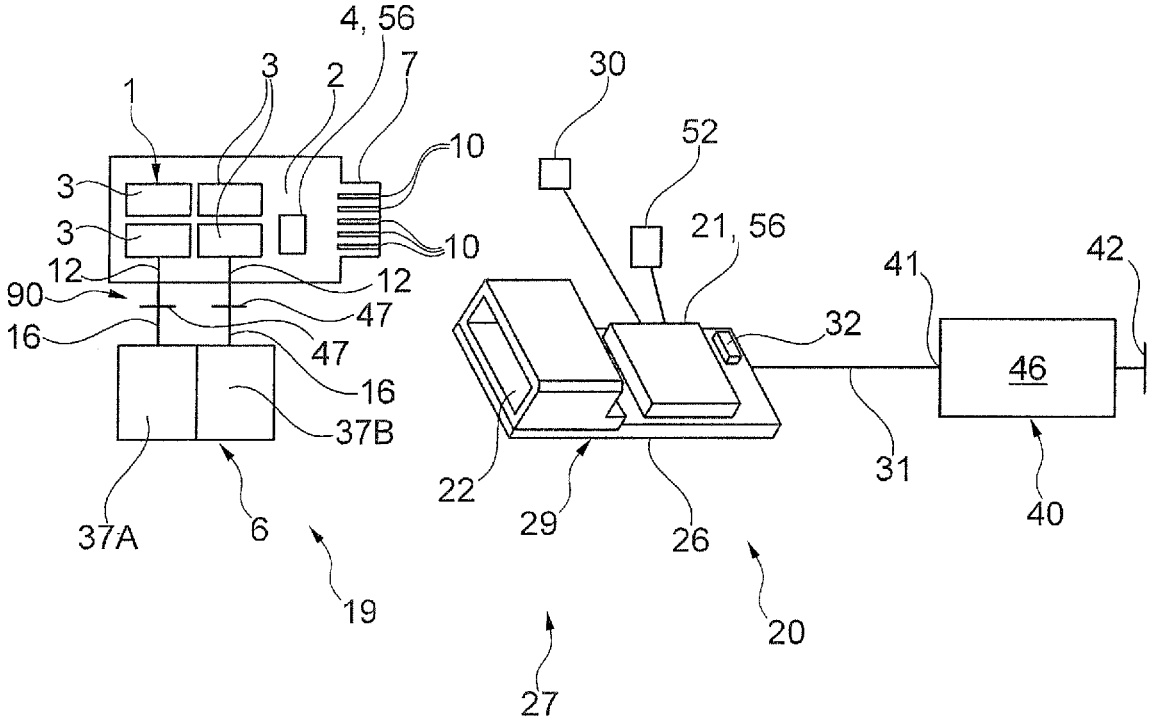
FIG. 1 A schematic representation of components of an e-cigarette in an embodiment according to the invention.

The inhaler 27 shown in FIG. 1 comprises a vaporizer device 1 for vaporizing one or a plurality of liquids from one or a plurality of liquid tanks 6 in a cartridge 19, and an advantageously reusable base part 20.

The vaporizer device 1 advantageously comprises a film-based carrier 2, which is connected or can be connected to a liquid tank 6. The vaporizer device 1 comprises a vaporizer 3 or a plurality of vaporizers 3, which are used for vaporizing liquid supplied by the vaporizer(s) 3 from the liquid tank 6. In the embodiment according to FIG. 1, the vaporizers 3 are arranged for example in a matrix format, in this case for example four vaporizers 3 in a 2×2 matrix format.

The liquid supplied to the vaporizer 3 is transformed into vapor/aerosol by the vaporizer 3. The in particular electrical vaporizer 3 comprises at least one, preferably a plurality of electrical resistor heating elements 15; see FIGS. 3 and 4.

The vaporizer device 1 is advantageously designed in a structural unit with a liquid tank 6 as a replaceable cartridge 19. Every cartridge 19 advantageously comprises a cartridge housing, which can be formed at least partially by the liquid tank 6 and/or at least partially by the vaporizer device 1. The at least one liquid tank 6 can be refillable so that the cartridge 19 is a reusable part. As an alternative, the cartridge 19 can also be designed as a disposable part.

The vaporizer device 1 or every cartridge expediently comprises a vapor outlet opening through which the vapor and/or aerosol that is generated exits from the vaporizer device 1 and can be blended with the airflow flowing through the inhaler 27 in order to be inhaled by the consumer after exiting from the inhaler 27 through a suction opening.

The vaporizer device 1 preferably comprises a digital electronic control device 4, for example an application specific integrated circuit (ASIC), which can preferably be arranged on the carrier 2. The vaporizer(s) 3 of the vaporizer device 1 can be controlled individually or in groups by the corresponding electronic control device 4 and be heated with current from an energy storage system 46 in order to vaporize the liquid clinging to the heating elements 15.

The vaporizer device 1 or the cartridge 19 comprises an electrical contact element 7, in this case in the form of an electrical plug, having a plurality of electrical contacts 10. The contacts 10 are connected to the electronic control device 4 by means of electrical lines in order to transmit sensor signals, control signals and/or electrical energy to the base part 20 of the inhaler 27. The vaporizer device 1 can comprise sensors, for example a temperature sensor for measuring the heating temperature and/or a pressure sensor for measuring the flow pressure.

The base part 20 comprises a control unit 29 and an energy storage unit 40 that is connected to or to be connected to the control unit 29. The control unit 29 comprises an electronic controller 21 and an electrical contact element 22 connected therewith, in this case in the form of a plug socket matching the plug 7. The control unit 29 also advantageously comprises a user interface 32, in particular a wireless interface, for example a Bluetooth interface, via which a user can control or adjust the inhaler 27 by means of a mobile communication device, for example a smart phone, and/or obtain information from it. The electronic controller 21 and the electrical contact element 22 are advantageously arranged on a common circuit board 26. The entirety of the electronic control device 4 and the electronic controller 21 is designated as a part of this application as an electronic control apparatus 56 of the inhaler 27.

The electrical plug 7 and the electrical plug socket 22 are configured to correspond to each other so that by inserting the plug 7 into the plug socket 22 an electrical connection is established between the vaporizer device 1 and the base part 20 for transmitting signals, data and/or electrical power. In the vaporizer device 1, supply currents and signals are forwarded from the plug 7 to the least one vaporizer 3 and/or to the sensors. The plug 7 and the plug socket 22 each advantageously have the same number of electrical contacts 10.

To connect the vaporizer device 1 to the base part 20, in some embodiments, the cartridge 19 is slid into the base part 20 parallel to the longitudinal axis thereof, thereby inserting the plug 7 into the plug socket 22 and establishing the electrical connection.

The base part 20 or the control unit 29 advantageously comprises a number of electrical contact elements 22, in this case plug sockets, corresponding to the number of cartridges 19 in order to facilitate the individual replacement of individual cartridges 19.

An identifier or ID (identification information) of the vaporizer device 1 is permanently stored in the electronic control device 4 of the vaporizer device 1. Because of the connection of the cartridge 19 to the base part 20, it is possible for the electronic controller 21 to read the identifier from the control device 4 and carry out or initiate a type-specific and individual control of the respective vaporizer and/or the vaporizer device 1 optimized with respect to the relevant liquid, for instance by transmitting control and/or regulation commands to the control device 4. Control data for a plurality of identifiers corresponding to a plurality of different vaporizers 3 or vaporizer types and/or liquids are expediently stored for this purpose in the electronic controller 21 of the base part 20, for example in the form of a database.

The energy storage unit 40 comprises an energy storage system 46, a battery interface 41 for connecting the control unit 29 to the energy storage unit 40 via electrical lines 31, a charging interface 42 and electronic circuit with charging electronics. The control unit 29 is supplied with power via the battery interface 41. In addition, analog and/or digital signals can be transmitted between the energy storage unit 40 and the control unit 29 via the battery interface 41. In an advantageous embodiment, the electrical lines 31 comprise a digital data bus. For example, information about the charging status of the energy storage system 46 or diagnostic data can be transmitted between the control unit 29 and the energy storage unit 40 via the electrical connection 31 between the base part 20 and energy storage unit 40. The energy storage system 46 can be a disposable battery or a rechargeable battery, for example a lithium ion battery, which can be charged via the charging interface 42, for example a USB interface, or advantageously wirelessly via an inductive charging interface.

The or each liquid tank 6 respectively forms a liquid reservoir 37A, 37B or a plurality of liquid reservoirs 37A, 37B. In particular, a multi-chamber tank 6 can be provided for forming a plurality of reservoirs 37A, 37B, etc. As an example, a cartridge 19 with a double chamber tank 6 for forming two reservoirs 37A, 37B is provided in FIG. 1. Of course, a liquid tank 6 can also form more than two reservoirs 37A, 37B. In the embodiment according to FIG. 1, two vaporizers 3 each are assigned to a reservoir 37A, 37B as a an example. Of course, one reservoir 37A, 37B can be assigned only one vaporizer 3 or more than two vaporizers 3.

Hybrid forms between single and multi-chamber tanks are possible, for example a double chamber tank and a single chamber tank can be provided.

Each liquid reservoir 37A, 37B, etc. is connected to one or a plurality of vaporizers 3 via an associated liquid feed line 16 in order to transport liquid from a corresponding opening of the liquid tank 6 to the vaporizer(s) 3 and vaporize it there. The liquid feed lines 16 can comprise for example passage openings 38 in an intermediate section between the carrier 2 and the liquid tank 6; see FIGS. 3 and 4.

Arranged advantageously between each vaporizer 3 and the associated liquid reservoir 37A, 37B, etc., hence in the liquid feed line 16, is a capillary element 12, which conveys liquid by means of the capillary effect, for example using micro-channels, from the liquid tank 6 to the vaporizer 3 in order to ensure the moistening of the vaporizer 3 and the continuous subsequent conveyance of liquid. The capillary element 12 can comprise for example a pore element with an optimized pore size, an open-pored foamed element, a sponge element and/or lamellar structure. A vaporizer unit 90 comprises the vaporizer device 1 and the capillary element 12.

The one or more liquids in the reservoirs 37A, 37B, etc. advantageously comprise one or more components from the group of 1,2-proplyene glycol, glycerin, water, at least one active ingredient, in particular nicotine, and/or at least one flavoring agent (flavor) in the same and/or different mixing ratios.

The vaporizer device 1 preferably comprises a standardized liquid interface 47 for connecting the liquid tank 6 to the vaporizer device 1, in particular to the carrier 2 thereof. The liquid interface 47 is arranged advantageously on the side of the carrier 2 facing the vaporizer or opposite from the vaporizer 3. The liquid from the reservoir(s) 37A, 37B is made available at the liquid interface 47 and is guided through an advantageous passage opening through the carrier 2 to the vaporizer(s) 3. The liquid interface 47 can be sealed for example by means of a sealing element. The tank 6 can be connected to the vaporizer device 1 so it is detachable or non-detachable for the consumer. The thickness and/or rigidity of the carrier can preferably vary and for example can be thin and flexible in the region of the heating elements 15, whereas the connection to the liquid tank 6 and/or the outer edges of the carrier 2 serving as the mounting can be thick and/or rigid.

Figure 2:
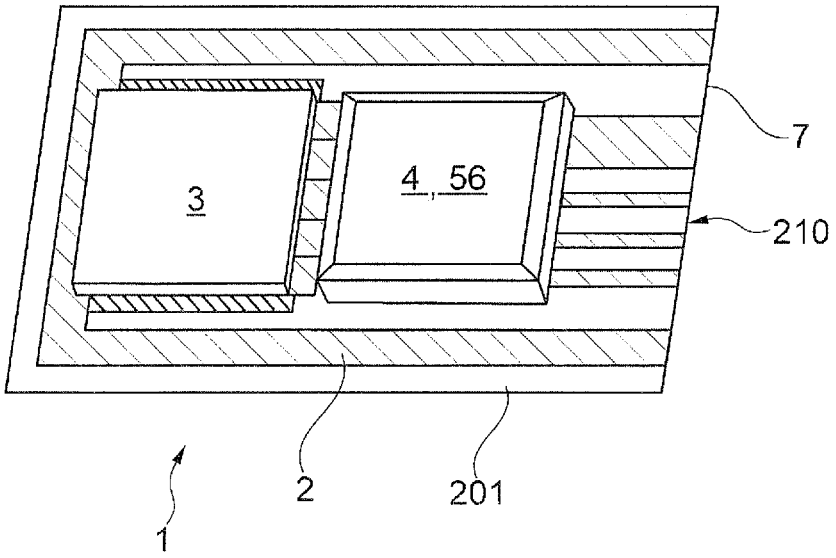
FIGS. 2 and 3 Schematic representations of a carrier in a layer structure in embodiments of the invention.

FIG. 2 shows an embodiment of the carrier 2 of the vaporizer device 1 according to the invention. The carrier 2 is film-based and comprises a polymer film 201, which preferably gives the carrier 2 its geometry. Formed on an edge 210 of the carrier 2 is the plug connection 7, for example in that the polymer film 201 is mechanically reinforced there, thicker and/or has more bending strength than in other regions of the carrier 2. The carrier 2 also comprises a metal film 202, which forms conducting tracks and contacts 10, 211, 212, preferably also the contacts 10 of the plug 7, 20. The vaporizer 3 enables a planar vaporization of liquid. A possible realization of a planar vaporizer with separable regions is described in Patent Application DE 10

2016 120 803.5, whose disclosure content in this respect is incorporated in the present application.

In this embodiment, the carrier 2 comprises the vaporizer 3 and the control device 4. The vaporizer 3 is integrated into the carrier and the heating elements 15 of the vaporizer 3 are formed by the corresponding structured metal film 202. The control device 4 is preferably connected electrically to the vaporizer device 1 via conducting tracks by means of a plurality of contacts 211, 212, for example solder contacts or plug contacts. The conducting tracks are also located in the metal film 202 and/or in a preferred embodiment in a metal layer 207, which can also form the contacts 10; see FIG. 4.

The circuit carrier 2 can be attached preferably directly on the liquid tank 6, wherein the fluidic connection to the liquid tank 6 can be accomplished directly via an opening 38, 204, 205 beneath the heating elements 15 or via the capillary structure 12 that is attached between them. The capillary structure in this case can preferably be a single or multilayer non-woven material, for example made of glass fibers, chemical and thermally stable polymer fibers or the like. The carrier 2 can preferably be attached on a planar opening of the liquid tank 6.

When a consumer puffs on the inhaler 27, a negative pressure is applied to the inhaler 27, which implies an air flow. The air flow passes by the vaporizer device 1, the vaporizer 3 or the heating elements 15 and carries the aerosol or the vapor generated by the vaporizer 3 with it and supplies it to the consumer.

Figure 3:
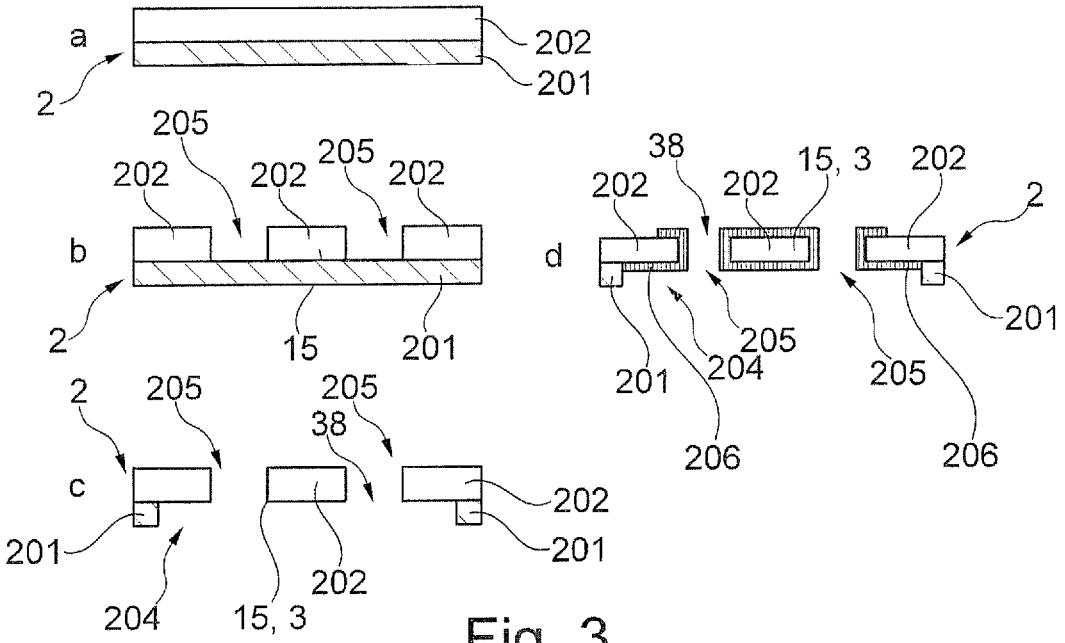

FIG. 3 shows an embodiment of a carrier 2 for a vaporizer device 1 according to the invention with a layer structure comprising substantially two layers 201, 202 and a passivating coating 206, which could likewise be understood as a layer. FIGS. 3*a* to 3*d* show the carrier 2 in sectional views during different fabrication steps that are possible, but not required; the fabrication of the vaporizer device 1 according to the invention can also take place in other ways than the ones described.

FIG. 3*a* shows the carrier 2 with the polymer film 201 and metal film 202 that are in contact with each other in a planar manner. A polymer is used as the starting material for the film substrate of the polymer film 201, which is not meltable and is chemically resistant, for example polyester film or polyimides. A copper film 202 laminated to the polymer film 201 can preferably be used as the metal film 202. However, other metals, such as nickel, and other application methods, such as galvanic deposition, adhesion and/or lamination, can be used for example. Connecting the layers of the carrier can also be accomplished by means of adhesion.

Starting from FIG. 3*a*, a fabrication step was first carried out in FIG. 3*b* in order to process and structure the metal film 202. The metal film 202 can be structured preferably via photolithography, wet etching and/or by means of other methods in order to preferably generate in one fabrication step both the heating elements 15 of the vaporizer 3 and contacts 10 for other electronic components, such as the control device 4 or the plug connection 7, as well as the conducting tracks. However, the polymer film 201 can also be processed to begin with in other fabrication methods.

The second openings 205 are formed by the structuring of the metal film 202. The formation of the second openings 205 in the metal film 202 means that the respective second openings 205 are delimited by different regions of the metal film 202. The different regions of the metal film 202 which delimit the second openings 205 can serve separately as electrical conductors and thus form conducting tracks and heating elements 15. In this exemplary embodiment, two second openings 205 form a heating element 15 located between them. In other embodiments, the number of second openings 205 and heating elements 15 can vary; see FIG. 4.

A result of processing the polymer film 201 is shown in FIG. 3*c*. The polymer film 201 makes a first opening 204 available, which can be produced via plasma etching, for example. The first opening 204 is arranged such that it can communicate with the second opening 205, i.e., the fluid can penetrate through the carrier 2, by passing through both the first opening 204 and the second opening 205. The first opening 204 and the second opening 205 thus form a fluid permeable passage opening 38. As a result, the passage opening 38 facilitates the transport of liquid from the liquid tank 6, which is preferably arranged beneath the carrier 2, to the vaporizer 3 or the heating elements 15. The first opening 204 is preferably larger than the second opening 205 in order to prevent unnecessary contact between the heating elements 15 and the polymer film 201 as well as an unnecessary obstacle for the liquid transport through the passage opening 38.

According to a preferably final and optional fabrication step, a passivating coating 206 is applied to the metal surface of the metal film 202 in the region of heating elements 15, as shown in FIG. 3*d*. The passivating coating 206 is preferably configured to envelop exposed regions of the metal film and regions of the metal film 202 that are not in contact with the polymer film 201. Excluded from the passivating coating 206 are preferably regions facing away from the liquid tank 6 which are intended to accommodate electrical components, such as the control device 4, the plug 7, contacts 10, 211, 212 and/or conducting tracks. All regions of the metal film 202 which can potentially come into contact with the liquid from the liquid tank 6 and/or with the vapor or aerosol are preferably provided with a passivating coating 206. The passivating coating 206 thereby prevents the transport of possibly undesirable substances, which can leach out of the heating elements 15.

The film-based carrier 2 is at least partially flexible because of the layer structure due to at least the polymer film 201 and the metal film 202. The polymer film 201 and/or the metal film 202 can comprise different regions with different thicknesses. This can be used to design the bending strength to be different in different regions. In particular, it can be advantageous for the polymer film 201 to be especially rigid and/or thick at the rim of the carrier 2 in order to give carrier 2 a specific form. In addition, an edge 210 of the carrier 2 can be configured to be especially rigid and/or thick in order to make it possible to integrate the plug connector 7 directly into the vaporizer device 1. Furthermore, regions of the carrier 2 that are configured to be more stable and/or thicker can be used to make the contacts 211, 212 available.

The provision of liquid, which is vaporized at the heating elements 15, is preferably facilitated by the liquid interface 47 and/or the capillary element 12. The liquid interface 47 and/or the capillary element 12 can thereby extend through the carrier 2 through the first opening 204 and the second opening 205 to the heating element 15 or the metal film 202 and/or the passivating coating 206. The capillary element 12 together with the carrier 2 can be used in preferred embodiments as a closure of the liquid tank 6.

The vaporizer device 1 is preferably configured to control or heat, in sections, the vaporizer 3 at the individual, separately regulated heating elements 15 in order to achieve the greatest possible vapor or aerosol quality. Individual, separately regulated heating elements 15 are described in Patent Application DE 10 2017 111 119.0, whose disclosure content in this respect is incorporated in the present application.

Figure 4:
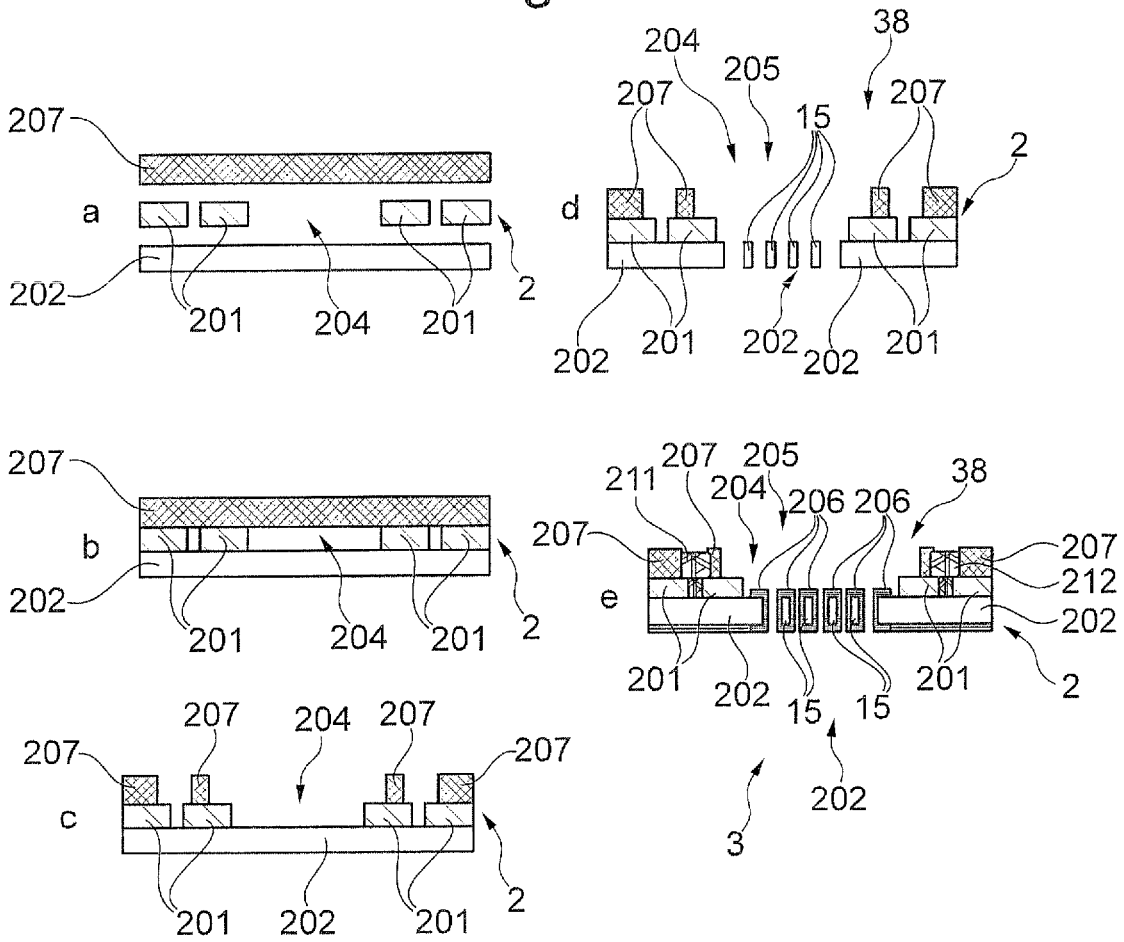
FIG. 4 A schematic representation of a carrier in a layer structure with contacts in an embodiment of the invention.

FIG. 4 shows another embodiment of a carrier 2 of the vaporizer device 1 with a layer structure comprising substantially three layers 201, 202, 207 and the passivating coating 206, which could like be understood as a layer. FIGS. 4*a* to 4*e* show the carrier 2 in sectional views during different fabrication steps that are possible, but not required; the fabrication of the vaporizer device according to the invention can also take place in other ways than the ones described.

FIG. 4*a* shows the preparation of the three layers 201, 202, 207 of the carrier 2 comprising the polymer film 201 as well as the metal film 202 and a metal layer 207. The metal film 202 is applied to the side of the polymer film 201 opposite from the metal layer 207. The use of a metal layer 207 that is separate from the metal film 202 can be required to achieve an optimal function, because the heating elements 15 and electrical conducting tracks, contacts 10, plug connector 7 etc. can be fabricated from different materials for example. To this end, a substantially three layer structure is provided as shown in this embodiment. It can be advantageous in this embodiment if the polymer film 201 is already structured, for example by punching, cutting, laser cutting, etching and/or plasma etching. In this example, the polymer film 201 comprises a first opening 204 as well as other openings for accommodating contacts 211, 212.

It can be advantageous for the carrier 2 to have different regions having different thicknesses and/or rigidities in order to accommodate the geometry required by the installation in the inhaler.

As FIG. 4*b* shows, the metal layer 207 of a highly conductive metal, for example copper, can be applied or laminated to the structured polymer film 201 on the one side of the polymer film 201, and the metal film 202, for example nickel, nickel-iron alloys or the like, can be applied to the other side of the polymer film 201.

FIGS. 4*c* and 4*d* show the structuring of the metal film 202 and the metal layer 207. In this example, first the metal layer 207 and then the metal film 202 are structured. In other embodiments, said fabrication steps can be also be interchanged or be performed at the same time.

The metal layer 207 is structured so that it is configured preferably together with the polymer film 201 to accommodate contacts 211, 212 and/or form conducting tracks and/or contacts 10. The metal layer 207 preferably forms the contacts 10 of the plug connector 7 of the vaporizer device 1.

The structuring of the metal film 202 forms a plurality of second openings 205 in this embodiment. Every adjacent pair of second openings 205 forms an electrical resistor, which can be controlled separately and be used as a heating element 15. In this exemplary embodiment, five second openings 205 form four heating elements 15. The heating elements 15 as well as the regions of the polymer film 201 located at the rim delimit the second openings 205. The second openings 205 are arranged so that they communicate in a fluid permeable manner with the first opening 204 thereby forming a fluid permeable passage opening 38.

In a preferably final and optional fabrication step, a passivating coating 206 is applied to the metal surface of the metal film 202 in the region of the heating elements 15, as shown in FIG. 4*e*. The passivating coating 206 is preferably configured to envelop the exposed metal film and the metal film 202 that is not in contact with the polymer film 201 and not in contact with the metal layer 207, with the exception of preferably individual regions facing away from the liquid tank 6, which are intended to accommodate electrical components, such as the control device 4, the plug 7, contacts 10, 211, 212 and/or conducting tracks.

All regions of the metal film 202 which can potentially come into contact with the liquid from the liquid tank 6 and/or with the vapor or aerosol are preferably provided with a passivating coating 206. The passivating coating 206 thereby prevents the transport of possibly undesirable substances, which can leach out of the heating elements 15. Preferably, after the metal film 202 is structured, the contacts 211, 212 can also be connected through in order to establish an electrical connection between the metal film 201 and for example the metal layer 207, and/or in the contacts 211, 212, for example through electronic components mounted by tin solder, such as the control device 4, for example.

The metal layer 207 is preferably provided with a passivating coating 206 (not shown here) in order to prevent the transport of possibly undesirable substances, which can leach out of the metal layer 207. The properties of the passivating coating 206 of the metal layer 207 can advantageously correspond to those of the metal film 202. The metal layer 207 with the contacts 211, 212 preferably serves to create a circuit carrier.

The number of openings 204, 205 can vary in other embodiments that are not shown.

The average diameter or the edge length of the second openings 207 is preferably in the range between 5 μm and 1 mm, further preferably in the range between 30 μm and 250 μm, even more preferably in the range between 50 μm and 100 μm. These dimensions advantageously produce a capillary effect so that liquid penetrating at the liquid interface 47 rises upwards to the vaporizer 3 by means of the capillary element 12. The surface ratio of the second openings 205 to the heating elements 15 is for example in the range between 10% and 50%, advantageously in the range between 15% and 40%, even more advantageously in the range between 20% and 30%, and is 25% for example.

The edge lengths of the surfaces of the vaporizer device 1 provided with heating elements 15 are for example in the range between 0.5 mm and 3 mm. The dimensions of the surfaces of the vaporizer device 1 provided with heating elements 15 can be for example: 0.95 mm×1.75 mm; 1.9 mm×1.75 mm or 1.9 mm×0.75 mm. The edge lengths of the vaporizer device 1 or of the carrier 2 can be for example in the range between 0.5 mm and 5 mm, preferably in the range between 0.75 mm and 4 mm, more preferably in the range between 1 mm and 3 mm. The surface of the vaporizer device 1 or of the carrier 2 (chip size) can be 1 mm×3 mm or 2 mm×3 mm for example.

The number of second openings 205 or heating elements 15 is preferably in the range between four and 1000. This allows the heat input to be optimized and a guaranteed high vaporization output as well as a sufficiently large vapor outlet surface to be realized.

The second openings 205 are arranged advantageously in the form of a square, rectangular, polygonal, round, oval or other shaped array. The array can be configured in the form of a matrix with s columns and z rows, wherein s is advantageously in the range between 2 and 50 and more advantageously in the range between 3 and 30 and/or z is advantageously in the range between 2 and 50 and more advantageously in the range between 3 and 30. This allows an arrangement of the second openings 205 or the heating elements 15 to be realized, which is effective and simple to produce, and has a guaranteed high vaporization output.

The metal film 202 can also be structured in such a way that the shapes of the heating elements 15 produced by the second openings 205 or the shapes of the second openings 205 are based on bionic structures.

The cross section of the second openings 205 can be square, rectangular, polygonal, round, oval or another shape, and/or change in sections in the longitudinal direction, in particular, increase, decrease or stay the constant.

The plurality of heating elements 15 can preferably be controlled or heated differently. The duration of the individual vaporization steps at different temperatures and/or a vaporization of the individual components of the individual portions of the liquid can thereby be kept short and/or be timed with a control frequency in such a way that the consumer is not able to perceive the gradual vaporization, and despite this a largely homogeneous, flavor-conforming, repeatable, precise aerosol formation can be guaranteed. In particular, first a vaporization of a component of the liquid with a lower boiling point takes place during a first vaporization interval at a first temperature A and then a vaporization of a component with a higher boiling point during a second vaporization interval at a second temperature B, which exceeds temperature A.

The sequence of the vaporization process will be explained in the following.

A voltage source for the heating elements 15 is activated to vaporize liquid. The voltage Uh is set in such a way that the vaporization temperature in the heating elements 15 is adjusted to the individual vaporization behavior of the liquid mixture that is used. This prevents the risk of local overheating and thus the generation of harmful substances.

As soon as a quantity of liquid which corresponds to or is associated with the volume of the liquid located on the surface of the vaporizer 3 is vaporized, the source of the heating voltage is deactivated. Because the properties and quantity of the liquid are advantageously exactly known and the heating elements 15 have a measurable temperature dependent resistor, this point in time can be determined or controlled very precisely. Therefore, the energy absorption of the vaporizer device 1 is able to be reduced as compared to known devices, because the required vaporization energy can be introduced in a metered and thus exact fashion.

Once the heating process is concluded, the heating elements 15 are predominantly or completely freed of fluid liquid. The heating voltage is then kept switched off until the surface of the heating elements 15 is re-moistened through the subsequent conveyance of liquid by the capillary element 12 for example.

As soon as this is the case, the next heating cycle can be begun by switching on the heating voltage.

The control frequency of vaporizer 3 generated by the source of the heating voltage and regulated by the control device 4 is advantageously in the range of 1 Hz to 50 kHz, preferably in the range of 30 Hz to 30 kHz, even more advantageously in the range of 100 Hz to 25 kHz. Different heating elements 15 can be heated with control frequencies which are different, the same, or vary or are constant in terms of time in order to achieve a high and consistent level of vapor and/or aerosol quality.

The frequency and the duty cycle of the heating voltage Uh for the heating elements 15 are advantageously adjusted to the natural oscillation or natural frequency of the bubble oscillations during bubble boiling. Therefore, the period duration 1/f of the heating voltage can advantageously be in the range between 5 ms and 50 ms, more advantageously between 10 ms and 40 ms, even more advantageously between 15 ms and 30 ms and be 20 ms for example. Depending on the composition of the vaporized liquid, frequencies other than the cited ones can be adjusted optimally to the natural oscillation or natural frequency of the bubble oscillations.

It addition, it has been shown that the maximum heating current generated by the heating voltage Uh should be no more than 7 A, more preferably no more than 6.5 A, even more preferably no more than 6 A and optimally be in the range between 4 A and 6 A in order to guarantee concentrated vapor while avoiding overheating.

The conveyance rate of the capillary element 12 is in turn optimally adjusted to that of the vaporization rate of the vaporizer 3 or of the heating elements 15 so that sufficient liquid can be subsequently conveyed at all times.

EMBODIMENTS

Embodiment 1

Vaporizer device (1) for an inhaler (27), in particular for an electronic cigarette product, comprising:

an electrical vaporizer (3) having one or more heating elements (15) for vaporizing liquid supplied by the vaporizer (3), characterized in that a carrier (2) is formed of a layer system with a polymer film (201) and at least one metal film (202) in contact with the polymer film (201) in a planar manner, the polymer film (201) comprises at least one fluid permeable first opening (204), the metal film (202) comprises at least one fluid permeable second opening (205) communicating with the first opening (204), and the metal film (202) forms the heating elements (15), wherein the heating elements (15) are arranged delimiting the second opening (205).

Embodiment 2

Vaporizer device according to embodiment 1, characterized in that the metal film (202) has a passivating coating (206) at least on the sections not in contact with the polymer film (201) and/or the heating elements (15).

Embodiment 3

Vaporizer device according to one of the preceding embodiments, characterized in that the carrier (2) comprises a metal layer (207), and the metal layer (207) is in contact with the polymer film (201) on the side opposite from the metal film (202).

Embodiment 4

Vaporizer device according to one of the preceding embodiments, characterized in that the carrier (2) comprises at least one contact (211, 212) for making electrical contact with an electronic component (4, 56).

Embodiment 5

Vaporizer device according to one of preceding embodiments, characterized in that the carrier (2) comprises regions having different thicknesses and/or bending strengths.

Embodiment 6

Vaporizer device according to one of the preceding embodiments, characterized in that the carrier (2) comprises a liquid interface (47) for the standardized connection with a liquid tank (6), wherein the liquid interface (47) communicates with the first opening (204) and/or the second opening (205).

Embodiment 7

Vaporizer device according to one of the preceding embodiments, characterized in that an electrical plug connector part (7) is formed on an edge (210) of the carrier (2), which is configured for reversible interaction with a corresponding plug connector part (22) of a base part (20) of the inhaler (27) and for supplying the vaporizer device (1) with electrical energy and/or for receiving control signals for the vaporizer device (1).

Embodiment 8

Vaporizer device according to one of the preceding embodiments, characterized in that an electronic control device (4) for controlling and/or regulating the vaporizer device (1) is mounted on the carrier (2).

Embodiment 9

Vaporizer unit (90) for an inhaler (27) comprising:

a vaporizer device (1) according to one of the preceding embodiments, and a capillary element (12) for conveying fluid to the vaporizer (3).

Embodiment 10

Vaporizer unit according to embodiment 9, characterized in that the capillary element (12) extends at least partially through the first openings (204) and/or through the second opening (205) in the carrier (2).

Embodiment 11

Cartridge (19) for an inhaler (27), comprising:

at least one vaporizer device (1) or vaporizer unit (90) according to one of the preceding embodiments, and a liquid tank (6).

Embodiment 12

Inhaler (27) comprising at least one vaporizer device (1), vaporizer unit (90) or cartridge (19) according to one of the preceding embodiments and a base part (20) communicating therewith.

Embodiment 13

Method for fabricating a vaporizer device (1) according to one of embodiments 1 to 8, characterized in that the carrier (2) is made by way of the following steps:

the polymer film (201) and the metal film (202) are connected to each other in a planar manner, the metal film (202) is structured in order to form the second opening (204), conducting tracks and/or heating elements (15), the polymer film (201) is structured in order to form the first opening (203).

Embodiment 14

Method according to embodiment 13, characterized in that the metal film (202) is provided with a passivating coating (206).

Embodiment 15

Method according to embodiments 13 or 14, characterized in that a metal layer (207) is connected to the polymer film (201) on the side of the polymer film (201) that is opposite from the metal film (202).

Embodiment 16

Method according to embodiment 15, characterized in that the metal layer (207) is provided with a passivating coating (206).

The invention claimed is:

1. A vaporizer device for an inhaler, comprising:

an electrical vaporizer having one or more heating elements for vaporizing liquid supplied to the electrical vaporizer; and a carrier formed of a layer system with a polymer film and at least one metal film in contact with the polymer film in a planar manner, wherein the polymer film comprises at least one fluid permeable first opening, wherein the at least one metal film comprises at least one fluid permeable second opening communicating with the at least one fluid permeable first opening, wherein the at least one metal film forms the one or more heating elements, wherein the one or more heating elements are arranged so as to delimit the at least one fluid permeable second opening, wherein the carrier comprises a metal layer, wherein the metal layer is in contact with the polymer film on a side of the polymer film opposite from the at least one metal film, and wherein an electrical connection between the at least one metal film and the metal layer is established via one or more contacts.

2. The vaporizer device according to claim 1, wherein the at least one metal film has a passivating coating at least on sections not in contact with the polymer film and/or the one or more heating elements.

3. The vaporizer device according to claim 1, wherein the carrier comprises at least one additional contact for making electrical contact with an electronic component.

4. The vaporizer device according to claim 1, wherein the carrier comprises regions having different thicknesses and/or bending strengths.

5. The vaporizer device according to claim 1, wherein the carrier comprises a liquid interface for a standardized connection with a liquid tank, and wherein the liquid interface communicates with the at least one fluid permeable first opening and/or the at least one fluid permeable second opening.

6. The vaporizer device according to claim 1, wherein an electrical plug connector part is formed on an edge of the carrier, wherein the electrical plug connector part is configured for reversible interaction with a corresponding plug connector part of a base part of the inhaler and for supplying the vaporizer device with electrical energy and/or for receiving control signals for the vaporizer device.

7. The vaporizer device according to claim 1, wherein an electronic control device for controlling and/or regulating the vaporizer device is mounted on the carrier.

8. A vaporizer unit for an inhaler, comprising:

a vaporizer device according to claim 1; and a capillary element for conveying fluid to the electrical vaporizer.

9. The vaporizer unit according to claim 8, wherein the capillary element extends at least partially through the at least one fluid permeable first opening and/or through the at least one fluid permeable second opening in the carrier.

10. A cartridge for an inhaler, comprising:

at least one vaporizer device according to claim 1; and a liquid tank.

11. A cartridge for an inhaler, comprising:

a vaporizer unit according to claim 8; and a liquid tank.

12. An inhaler, comprising:

at least one vaporizer device according to claim 1; and a base part communicating therewith.

13. An inhaler, comprising:

a vaporizer unit according to claim 8; and a base part communicating therewith.

14. An inhaler, comprising:

a cartridge according to claim 10; and a base part communicating therewith.

15. A method for fabricating a vaporizer device according to claim 1, wherein the carrier is made by way of the following steps:

connecting the polymer film and the at least one metal film to each other in a planar manner;

structuring the at least one metal film in order to form the at least one fluid permeable second opening, conducting tracks, and/or heating elements; and structuring the polymer film in order to form the at least one fluid permeable first opening.

16. The method according to claim 15, wherein the at least one metal film is provided with a passivating coating.

17. The method according to claim 15, wherein a metal layer is connected to the polymer film on a side of the polymer film that is opposite from the metal film.

18. The method according to claim 17, wherein the metal layer is provided with a passivating coating.

* * * * *